US005402613A

United States Patent [19]

Giumenta et al.

[11] Patent Number: 5,402,613

[45] Date of Patent: Apr. 4, 1995

[54] CHIMNEY CAP

[76] Inventors: Frederic F. Giumenta, 80 Stanford Ct., Wantagh, N.Y. 11793; Frank J. Giumenta, 3333 Murdock Ave., Oceanside, N.Y. 11572

[21] Appl. No.: 162,271

[22] Filed: Dec. 7, 1993

[51] Int. Cl.[6] ..... F04H 12/28; F23J 13/08

[52] U.S. Cl. ..... 52/244; 52/199; 52/58; 454/3; 454/12

[58] Field of Search ..... 52/12, 58, 60, 199, 52/198, 244, 301; 454/3, 12

[56] References Cited

U.S. PATENT DOCUMENTS

| | | | |
|---|---|---|---|
| 2,423,672 | 7/1947 | Zucker | 454/12 |
| 2,956,495 | 10/1960 | Sablette | 454/3 |
| 3,363,369 | 1/1968 | Miller | 52/301 |
| 3,464,174 | 9/1969 | Rosenberg | 52/244 |
| 4,206,692 | 6/1980 | Johnston | 52/199 |
| 4,549,473 | 10/1985 | Alexander et al. | 454/3 |
| 4,732,078 | 3/1988 | Giumenta et al. | 454/3 |
| 4,890,546 | 1/1990 | Venge | 52/199 |
| 5,305,562 | 4/1994 | Sapia | 52/12 |

*Primary Examiner*—Carl D. Friedman
*Assistant Examiner*—Winnie S. Yip
*Attorney, Agent, or Firm*—Philip Sands

[57] ABSTRACT

A chimney cap for protecting the upper open end of a chimney flue from the ingress of undesirable elements, such as squirrels, raccoons and birds or the like, is disclosed. The cap comprises a housing having four perforated sides which are detachably connected to one another in succession, the four sides each being formed from a flat metal blank provided with slots at one vertical edge portion and upturned tongues at the opposite vertical edge portion, the tongues of each perforated side projecting through the slots of an adjoining perforated side to thereby secure the perforated sides to one another and present a four-sided enclosure. The foregoing abstract is neither intended to define the invention disclosed, nor is it intended to be limiting as to the scope in any way.

4 Claims, 2 Drawing Sheets

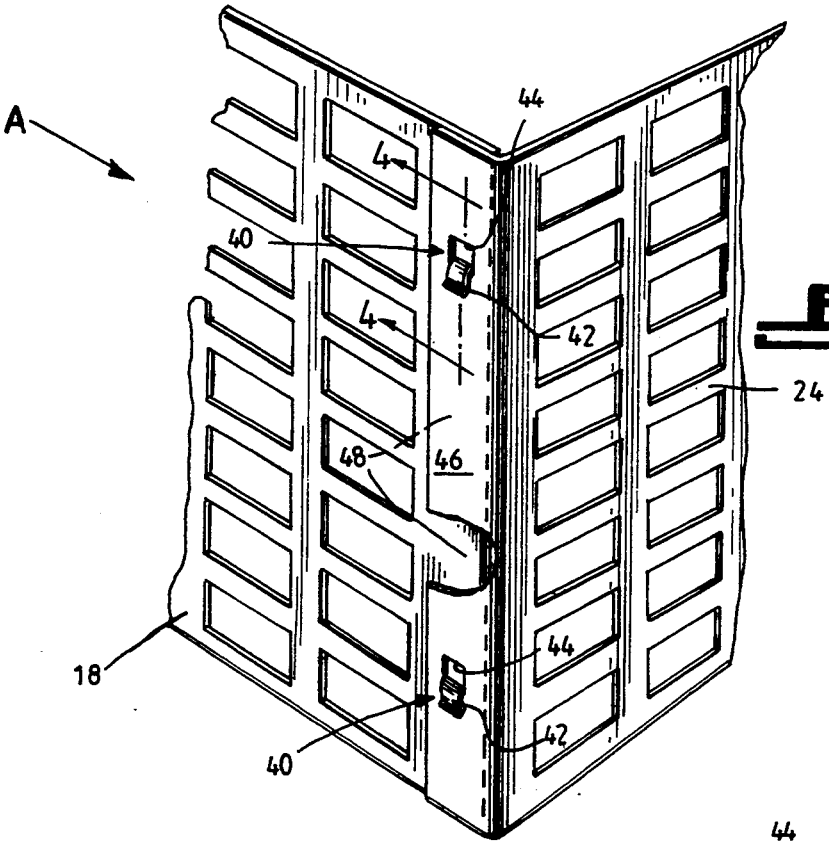
Fig. 2
Fig. 3
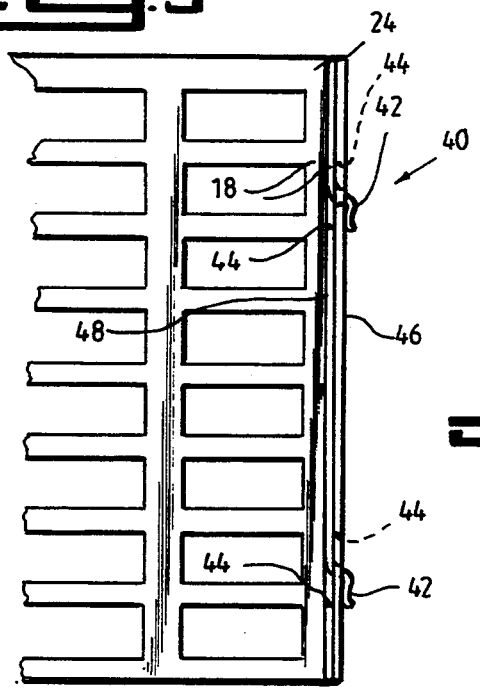
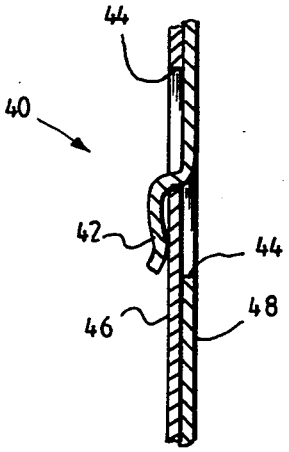
Fig. 4

CHIMNEY CAP

BACKGROUND OF THE INVENTION

The invention relates generally to a chimney cap for protecting the upper open end of a chimney flue from the ingress of undesirable elements in the form of small animals such as squirrels, rodents, or raccoons and the like, as well as leaves from the overhanging tree limbs and the rain.

It is another object of the resent invention to provide a chimney cap which does not interfere with the continuous movement of air through the fireplace and chimney and, thereby, present no obstacle to a continuous and forceful up-draft in the chimney flue.

It is still a further object of the present invention to provide a chimney cap for protecting chimney flues, and that can be installed simply, rapidly, and with a minimum amount of tools or the like.

It is still a further object of the present invention to provide a chimney cap that can be manufactured rapidly, inexpensively, and yet remain durable and reliable throughout its life on a chimney flue.

It is another object of the present invention to provide a chimney cap the four-sided housing of which is readily collapsible for storage, packaging and transportation to a site to be installed without the need for additional fastening elements, such as screws, nuts or bolts, to hold the four sides to one another.

Further objects and advantages of this invention will become apparent as the following description proceeds.

SUMMARY OF THE INVENTION

Briefly stated, and in accordance with the invention, there is provided a chimney cap for protecting the upper open end of a chimney flue from the ingress of certain undesirable elements.

In the preferred embodiment, the chimney cap includes a housing having four perforated sides which are detachably connected to one another in succession, each of the perforated sides having a slotted flange at one edge portion and a tongued flange at an opposite distally spaced edge portion, each of the slotted flanges being bent perpendicular to and formed integral with its respective one of the perforated sides, each of the tongued flanges being coplanar and formed integral with its respective one of the perforated sides, each of the slotted flanges being formed with at least one slot, each of the tongued flanges being formed with at least one tongue, the perforated sides being arranged in succession with one another such that the slotted flange of one perforated side overlies a corresponding one of the tongued flanges of a separate but adjoining perforated side, the tongue of each of the tongued flanges being arranged at a location corresponding with and projecting through the slot formed in the slotted flange of the adjoining one of the perforated sides.

BRIEF DESCRIPTION OF THE DRAWINGS

Other objects and advantages of the invention will become apparent upon reading the following detailed description and upon reference to the drawings, in which:

FIG. 2 is a fragmented, partially perspective, elevational view of a typical perforated side of the present invention in its preferred form as secured to an adjoining mutually perpendicular perforated side;

FIG. 3 is a fragmented, elevated, end view of the perforated sides illustrated in FIG. 2, taken in the direction of arrow A; and FIG. 4 is a fragmented, sectional view taken along the line 4—4 in FIG. 2 of the tongue construction of the present invention.

Figure 1:
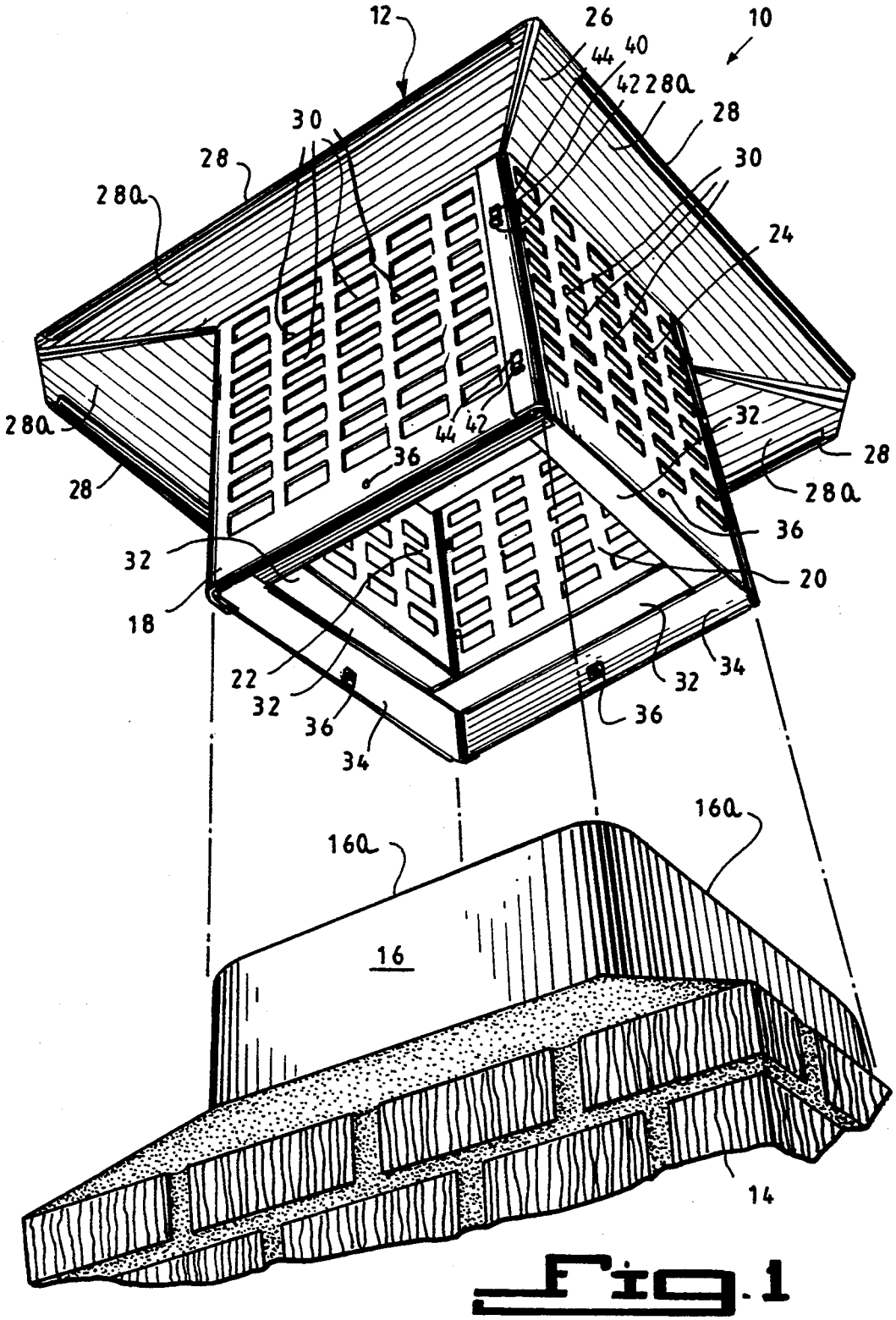
FIG. 1 is an exploded perspective view illustrating the present invention as it would be seated upon the upper exposed portion of a chimney flue, the chimney being illustrated as partially fragmented.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

With continued reference to the drawings, wherein like reference numerals have been used throughout to designate like elements, the present invention is designed generally by the reference character 10.

The invention 10 is in the form of a chimney cap generally denoted by the reference character 12. As illustrated in FIG. 1, the chimney cap 12 is adapted to be seated upon and protect a conventional brick chimney generally denoted by the reference character 14 having at the upper exposed end thereof a chimney flue liner denoted generally by the reference character 16.

The chimney cap 12 is adapted to be seated upon the liner 16 of the chimney 14 and thereby protect the chimney flue from ingress of undesirable elements in the form of animal life, plant life, or rain and snow and the like.

The chimney cap 12 is formed with four perforated sides, the opposite or opposing sides being generally identical to one another both in shape and dimension. For example, the front perforated side 18 and the rear perforated side 20 are substantially identical to one another, whereas the two perforated sides 22 and 24 of the chimney cap 12 are generally identical to one another.

Particularly, the sides 18, 20, 22 and 24 may all be of identical dimension and contour thereby forming a square-like array. Alternatively, the sides 18 and 20 may both be either larger or smaller than the sides 22 and 24, thereby presenting a rectangular-like array. In either instance, however, the opening at the lower portion of the chimney cap 12 must compliment the size and configuration of the opening **16*a* presented by the flue liner of the chimney 14**.

As is further illustrated in FIG. 1, the chimney cap 12 is provided with a roof 26 which is affixed by conventional means (welding or screws) to the four sides of the chimney cap 12, and is preferably inclined from each of the free edges thereof (as denoted by reference characters 28, respectively) upwardly toward the center of the chimney cap 12 to merge at a higher elevation. This will permit rain or other elements simply to slide vertically downwardly along the inclined portion of the roof and off the chimney cap 12.

In the preferred embodiment, the roof 26 is constructed such that there is a small overhang extending beyond each of the sides 18, 20, 22 and 24 of the chimney cap 12, and denoted generally by the reference characters **28*a*. The overhang of the roof 26 acts to insure that the elements slide off the roof and not into the housing or chimney flue 16**.

It will also be understood that with respect to the preferred embodiment of the present invention each of the side walls 18, 20, 22 and 24 is provided with substantially the same type of perforation, which may be either oval, circular, rectangular or square, or otherwise. The perforations are denoted generally by the reference characters 30.

The bottom open portion of the chimney cap 12 is provided with four flanges each denoted generally by the reference character 32. The flanges 32 extend in part perpendicular to the respective sides with which the flanges are integral, and thereby are designed to over-lie and rest upon the ledge or extreme upper edge 16*a* of the chimney flue 16.

Each of the perpendicular oriented flange portions 32 associated with the respective sides of the chimney cap 12 is formed as part of a secondary flange portion 34 which is bent upwardly and inwardly of its respective side of the chimney cap 12. The flange portions 32 which extend perpendicular to the plane of each of their associated sides of the chimney cap 12 are oriented in such a condition because of the generally upwardly or inturned flange portions 34 which extend parallel to the planes of their respective sides of the chimney cap 12.

By means of the flange portions 34 which extend upwardly and parallel to the planes of their respective sides of the chimney cap 12, and the bent portions 32 of the flanges which extend generally perpendicular to their respective associated sides of the chimney cap 12, the flange portions 32 present a shoulder for resting upon the uppermost exposed portion 16*a* of the chimney flue 16. In turn, the sides 18, 20, 22 and 24 of the chimney cap 12 act to surround, in close proximity, the vertical exterior of the chimney flue 16.

In order to affix, releaseably, the chimney cap 12 to the vertical exterior of the chimney flue liner 16, at the lower portion of each of the sides 18, 20, 22 and 24 there is provided a threaded opening into which a threaded bolt, identified in each instance by the reference character 36, can be turned, for example, by means of a screwdriver, into tight engagement with the vertical exterior of the flue liner 16 (see FIG. 1).

As a consequence, the chimney cap 12 can be installed upon the chimney flue 16, in rather tight-fit, surrounding relation, by simply positioning the chimney cap 12 above the chimney 14 and upon the flue 16. The flange portions 32 extending perpendicular to each of the sides of the chimney cap 12 will then act as an abutment or shoulder to maintain the chimney cap 12 in an upright position upon the ledge of the opening 16*a* of the chimney flue 16. The threaded bolts 36 can then be turned into tight frictional engagement with the vertical side surface of the chimney flue 16 and thereby maintain the chimney cap 12 of the present invention 10 in an operative position upon the chimney 14.

As best illustrated in FIGS. 2 and 3, the perforated sides of the housing of the present invention, for example, sides 18 and 22, are detachably connected to one another by means of a tongue-and-slot construction denoted generally by the reference character 40.

The tongue-and-slot construction 40 of the present invention takes the form of a pair of tongues 42 presented along one edge portion of each of the perforated sides 18, 20, 22 and 24, and a pair of slots 44 presented along an opposite edge portion of each of the perforated sides 18, 20, 22 and 24.

The tongue-and-slot construction 40 of the present invention provides for the detachable connection of the adjoining perforated sides, for example, sides 18 and 22, in mutually perpendicular relation.

In this regard, each of the perforated sides 18, 20, 22 and 24 is provided with a respective flange or edge portion 46 that is bent perpendicularly away from the balance thereof, and in which is formed a respective pair of the aforementioned slots 44, the slots each having a generally square-like configuration.

On the other hand, at a distally spaced edge portion 48 of each of the perforated sides 18, 20, 22 and 24, there is provided a respective pair of the aforementioned tongues 42 which are spaced from one another by a distance corresponding to the distance between the pair of slots 44 in an adjoining one of the perforated sides for selective insertion.

The tongues 42 are downturned in generally superposed relation upon their associated edge portion 48 of each of the perforated sides 18, 20, 22 and 24, and are formed integral with and as part thereof as best illustrated in FIG. 4, each tongue 42 having been stamped in a conventional manner, from a U-shaped slit, out of the sheet metal of the perforated side from which it is formed.

In the preferred form of the present invention, the tongues 42 are downturned in generally superposed relation upon their associated edge portion 48 such that at least in part each tongue 42 contacts its associated edge portion 48, thereby providing for a leaf-spring frictional contact with the edge portion 46 immediately surrounding a corresponding slot 44 through which that tongue 42 projects.

In essence, the thickness of the sheet metal of each edge portion 46 is frictionally held by a respective tongue 42 on one surface of the edge portion 46, and on the opposite surface by the opposing surface presented by the engaging edge portion 48.

As a consequence, the perforated sides 18, 20, 22 and 24 can be detachably connected to one another without the need of a single attendant tool simply by aligning them into successive mutually perpendicular relation, with the tongues 42 of one perforated side inserted through corresponding slots 44 in an adjoining perforated side.

The perforated sides can then be adjusted vertically slightly relative to one another such that the tongues 42 slide relative to their corresponding slots 44, and frictionally engage and constrain the surface area of the associated edge portion 46 immediately surrounding the slots 44.

In this manner, the perforated sides 18, 20, 22 and 24 will remain secured to one another to present a four-sided enclosure or chimney cap to which may be secured a roof 26, at the bottom of which is presented a four-sided abutment 32 for resting upon the ledge of the opening 16*a* of a chimney flue 16, as best illustrated in FIG. 1, for immediate and desired protective use.

What is claimed is:

1. A readily collapsible chimney cap for protecting the upper open end of a chimney flue from ingress of undesirable elements, said cap comprising a housing having four perforated sides which are detachably connected to one another in succession, each of said perforated sides having a slotted flange at one edge portion and a tongued flange at an opposite distally spaced edge portion, each of said slotted flanges being bent perpendicular to and formed integral with its respective one of said perforated sides, each of said tongued flanges being coplanar and formed integral with its respective one of said perforated sides, each of said slotted flanges being formed with at least one slot, each of said tongued flanges being formed with at least one tongue, said perforated sides being arranged in succession with one another such that the slotted flange of one perforated side overlies a corresponding one of said tongued flanges of a separate but adjoining perforated side, the tongue of each of said tongued flanges being arranged at a location corresponding with and projecting through the slot formed in the slotted flange of the adjoining one of said perforated sides.

2. A chimney cap as claimed in claim 1, wherein each of said slotted flanges is formed with a second slot spaced from the first said slot formed in each of said slotted flanges, and wherein each of said tongued flanges is formed with a second tongue spaced from the first said tongue formed in each of said tongued flanges, said perforated sides being arranged in succession with another such that the slotted flange of one perforated side overlies a corresponding one of said tongued flanges of a separate but adjoining perforated side and the tongues of each of said tongued flanges project through corresponding slots in the slotted flange of the adjoining one of said perforated sides.

3. A chimney cap as claimed in claim 1, wherein each said tongue formed in each of said tongued flanges is bent to overlie and extend generally parallel to the remainder of its respective tongued flange, but is spaced therefrom by a distance less than the tongue thickness.

4. A chimney cap as claimed in claim 1, wherein each of said perforated sides includes a base flange having two portions integrally connected to one another, one portion of each of said base flanges being bent upwardly internally of said chimney cap to lie generally in superposed relation against its associated perforated side, the other portion of each of said base flanges being bent perpendicularly from its associated perforated side internally of said housing, each said other portion of each of said base flanges cooperating with one another to form a four-sided abutment ledge to support said housing on a chimney flue.

* * * * *